US005107182A

United States Patent [19]

Sano et al.

[11] Patent Number: 5,107,182

[45] Date of Patent: Apr. 21, 1992

[54] PLASMA DISPLAY AND METHOD OF DRIVING THE SAME

[75] Inventors: Yoshio Sano; Keiji Nunomura, both of Tokyo, Japan

[73] Assignee: NEC Corporation, Japan

[21] Appl. No.: 512,953

[22] Filed: Apr. 23, 1990

[30] Foreign Application Priority Data

Apr. 26, 1989 [JP] Japan ..... 1-108003

[51] Int. Cl.[5] ..... G09G 3/10

[52] U.S. Cl. ..... 315/169.4; 340/772; 340/775; 313/586; 313/587; 313/485; 313/493

[58] Field of Search ..... 315/169.4; 340/772, 340/775; 313/586, 587, 485, 493

[56] References Cited

U.S. PATENT DOCUMENTS

| | | | |
|---|---|---|---|
| 4,005,402 | 1/1977 | Amano | 313/485 |
| 4,554,537 | 11/1985 | Dick | 340/775 |
| 4,703,225 | 10/1987 | Sohn | 313/587 |
| 4,728,864 | 3/1988 | Dick | 315/169.3 |
| 4,833,463 | 5/1989 | Dick | 340/775 |

OTHER PUBLICATIONS

G. W. Dick et al., A Three-Electrode ac Plasma HVCMOS Drive Scheme, 1986, pp. 212-215, SID 86 DIGEST.

Yoshikazu Kanazawa et al., Electronic Information Communication Society Research Report vol. 87, No. 408, pp. 53-58, Issue date Mar. 19, 1988.

*Primary Examiner*—Eugene R. LaRoche
*Assistant Examiner*—Tan Dinh
*Attorney, Agent, or Firm*—Laff, Whitesel, Conte & Saret

[57] ABSTRACT

A plasma display includes discharge gas spaces, first and second insulating substrates, stripe row electrodes, an insulating layer, a protective layer, stripe column electrodes, another insulating layer, phosphors, and ribs. The discharge gas spaces constitute a plurality of pixels. The first and second insulating substrates are arranged parallel to each other so as to sandwich the discharge gas spaces. The row electrodes are arranged on a surface of the first insulating substrate which opposes the discharge gas spaces. The first insulating layer is stacked on the stripe row electrodes. The protective layer is stacked on the insulating layer. The column electrodes are arranged on a surface of the second insulating substrate, which opposes the discharge gas spaces, in a direction perpendicular to the row electrodes. The second insulating layer is stacked on the column electrodes. The phosphors are stacked on the insulating layer at positions corresponding to the pixels, respectively. The ribs are arranged on the row electrodes so as to define the pixels. A method of driving the plasma display is also disclosed.

2 Claims, 7 Drawing Sheets

PLASMA DISPLAY AND METHOD OF DRIVING THE SAME

BACKGROUND OF THE INVENTION

The present invention relates to a so-called surface discharge, a dot matrix type color plasma display which is used for a personal computer and an office work station which have exhibited remarkable progress in recent years, or for a wall TV and the like which are expected to be developed in future.

As a conventional surface discharge, dot matrix type plasma display, a display having a structure shown in FIGS. 7A and 7B is available (SID International Symposium Digest of Technical Papers (1986), P. 212). Referring to FIGS. 7A and 7B, reference numeral 1 denotes a first insulating substrate; 2, a second insulating substrate made of glass or the like; 20 and 21, insulating layers; 22, a discharge gas space; 23, a rib for defining a gas space to form a pixel; 24, a transparent electrode; 25 and 26, a row electrode pair consisting of two parallel electrodes; $L_1$, a row electrode spacing between adjacent pixels; $L_2$, a row electrode width; and $L_3$, a discharge gap. An AC voltage is applied between the row electrodes 25 and 26. Once a discharge start pulse voltage is applied between the transparent electrode 24 and either of the row electrodes 25 and 26 so as to cause a discharge, the discharge serves as a firing source and sustains a discharge between the row electrodes 25 and 26. If a low pulse voltage for discharge extinction is applied between the row electrodes 25 and 26, the charge on the row electrode 25 or 26 is neutralized by this voltage, and the sustained discharge between the row electrodes 25 and 26 is stopped. As shown in FIG. 7A, therefore, if the stripe row electrodes 25 and 26 are arranged to perpendicularly cross the stripe transparent electrodes 24, a dot matrix type plasma display can be obtained.

In the structure shown in FIGS. 7A and 7B, however, since one pair of row electrodes are used for one display line, a fine electrode pattern is required for a ( high-resolution panel. This poses difficulty in the formation of an electrode pattern. In order to overcome this difficulty, a plasma display having a structure shown in FIGS. 8A and 8B is proposed (Technical Research Report of the Institute of Electronic Information and Communication, Vol. 87, No. 408, PP. 53 to 58, published on Mar. 19, 1988). Referring to FIGS. 8A and 8B, reference March numeral 37 denotes a bilateral electrode, partitioned by a barrier 38 at the middle, for discharging at electrodes at its both sides; and 35, a write electrode formed, as a film, on a rear glass 31.

In this plasma display, since the bilateral electrode 37 as one row electrode is commonly used for adjacent pixels, the row electrode interval $L_1$ shown in FIG. 7A is not required. For this reason, a high-resolution panel can be realized with the same electrode width as that of a conventional display. However, since the bilateral electrodes 37 and the write electrodes 35 are stacked on the same rear glass 31, the capacitance between them is increased. For this reason, if a voltage is applied to the bilateral electrode 37 or the write electrode 35, a capacitance is charged between them, resulting in an increase in power loss. In addition, since the time to charge a capacitance is required, such an arrangement is not suitable for a large-screen display requiring a high-speed operation.

SUMMARY OF THE INVENTION

It is an object of the present invention to provide a high-resolution color plasma display.

It is another object of the present invention to provide a highly reliable color plasma display.

It is still another object of the present invention to provide a method of easily driving a large color plasma display.

According to an aspect of the present invention, there is provided a plasma display comprising discharge gas spaces constituting a plurality of pixels, first and second insulating substrates which are arranged parallel to each other so as to sandwich the discharge gas spaces, stripe row electrodes arranged on a surface of the first insulating substrate which opposes the discharge gas spaces, an insulating layer stacked on the stripe row electrodes, a protective layer stacked on the insulating layer, stripe column electrodes which are arranged on a surface of the second insulating substrate, which opposes the discharge gas spaces, in a direction perpendicular to the row electrodes, an insulating layer stacked on the column electrodes, phosphors stacked on the insulating layer at positions corresponding to the pixels, respectively, and ribs, arranged on the row electrodes, for defining the pixels.

According to another aspect of the present invention, there is provided a method of driving a plasma display, comprising the steps of; applying a common voltage to odd row electrodes, applying independent voltages to even row electrodes, simultaneously selecting all the pixels located on both the sides of a given even row electrode by applying a write pulse to the given row electrode, and simultaneously and independently controlling the pixels located on both the sides of the given even row electrode by applying data pulses to column electrodes in synchronism with the write pulse.

According to the present invention, the problems posed in the conventional techniques are solved by employing the above-described arrangement.

In particular, in order to minimize the degree of micropatterning of electrodes, one row electrode is commonly used for pixels of adjacent rows as shown in FIGS. 1A to 1C. Therefore, the pixel pitch in the column direction can be reduced. The ribs are respectively arranged on the row electrodes in order to prevent transfer of a discharge in the column direction. Unlike the conventional plasma display shown in FIG. 8, the row electrodes corresponding to the bilateral electrodes 37 are arranged on the first insulating substrate, whereas the column electrodes corresponding to the write electrodes 35 are arranged on the second insulating substrate. With this arrangement, the capacitance between each row electrode and a corresponding column electrode can be greatly reduced, and the power consumption is reduced. This allows high-speed driving suitable for a large display.

In the prevent invention, since one row electrode is commonly used for pixels of adjacent rows, pixels cannot be selected in units of rows. However, by applying a common sustain voltage to the even row electrodes, and applying independent scanning voltages to the even row electrodes, two pixel rows located on both the sides of a given even row electrode can be simultaneously selected. In addition, the column electrodes are arranged in one-to-one correspondence with all the pixels located on both the sides of a given row electrode so that these pixels are simultaneously selected by a write pulse applied to the given even row electrode. Furthermore, the respective pixels can be simultaneously and independently controlled by a data pulse applied to the row electrode in synchronism with the write pulse.

Especially, in a color display, pixel arrangements shown in FIGS. 2 and 6 are widely employed because three colors must be displayed at the same time. When ON/OFF control of each pixel is to be performed by a so-called line-sequential scheme, pixels of two rows may be simultaneously selected and the respective pixels may be independently controlled in the pixel arrangements shown in FIGS. 2 and 6.

In such a case, the scheme of the present invention, in which pixels of two rows can be simultaneously selected and independently controlled with a simple row electrode arrangement, is very advantageous. The present invention will be described more in detail with reference to embodiments.

BRIEF DESCRIPTION OF THE DRAWINGS

FIGS. 1A to 1C show a plasma display according to the first embodiment of the present invention, in which FIG. 1A is a plan view of the plasma display, FIG. 1B is a sectional view taken along a line 1B - 1B' in FIG. 1, and FIG. 1C is a sectional view taken along a line 1C - 1C' in FIG. 1A;

FIGS. 5A to 5C show a plasma display according to the second embodiment of the present invention, in which FIG. 5A is a plan view of the plasma display, FIG. 5B is a sectional view taken along a line 5B - 5B' in FIG. 5A, and FIG. 5C is a sectional view taken along a line 5C - 5C' in FIG. 5A;

FIGS. 7A and 7B show a conventional surface discharge type plasma display, in which FIG. 7A is a plan view of the plasma display, and FIG. 7B is a sectional view taken along a line 7B - 7B' in FIG. 7A; and FIGS. 8A and 8B show another conventional surface discharge type plasma display, in which FIG. 8A is a plan view of the plasma display, and FIG. 8B is a sectional view taken along a line 8B - 8B' in FIG. 8A.

DETAILED DESCRIPTION OF THE PREFERRED EMBODIMENTS

Figure 1A:
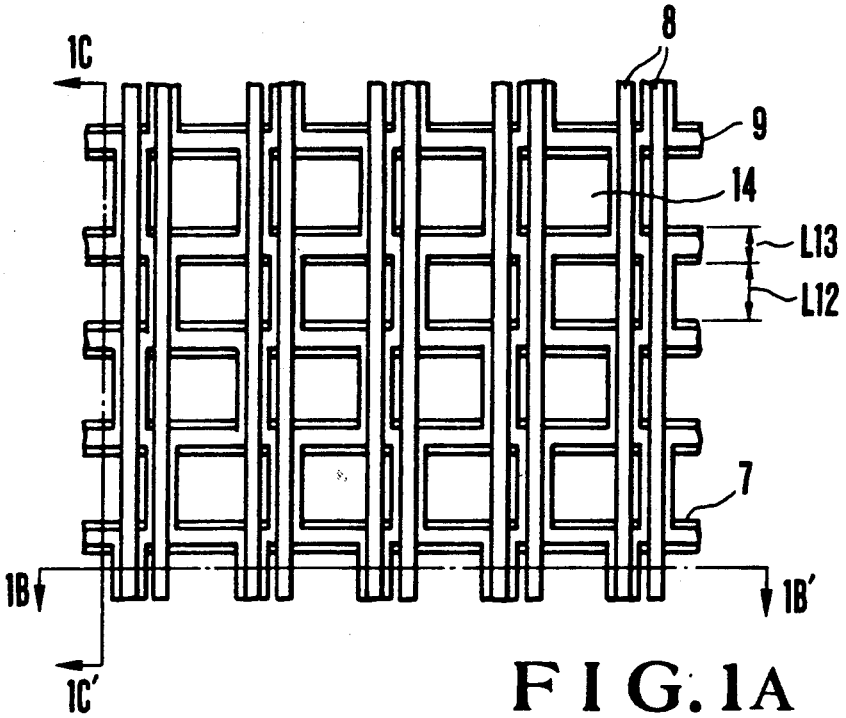
Figure 1B:
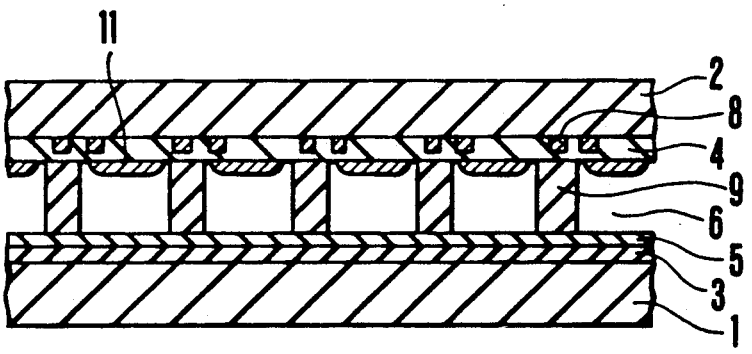
Figure 1C:
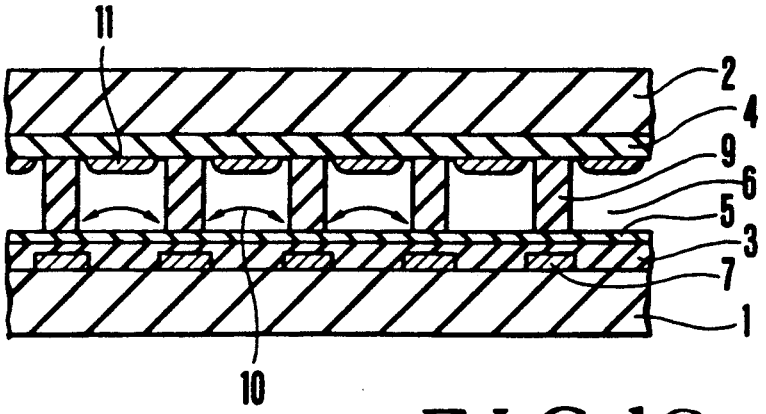

FIGS. 1A to 1C show a plasma display according to the first embodiment of the present invention. Referring to FIGS. 1A to 1C, reference numeral 1 denotes a first insulating substrate made of glass; 2, a second insulating substrate made of glass; 3 and 4, insulating layers made of alumina; 5, a protective layer made of MgO; 6, a discharge gas space in which a gas mixture of He and Xe is held; 7, a row electrode; 8, a column electrode; 9, a rib for defining the discharge gas space 6 to form a pixel; 10, a sustain discharge path, i.e., a path of a discharge generated between the adjacent row electrodes; and 11, a phosphor for generating visible light in response to ultraviolet rays upon discharge. Reference symbol $L_{12}$ denotes a sustain discharge gap defined by the adjacent row electrodes; and $L_{13}$, a row electrode width. Reference numeral 14 denotes a pixel. In this case, as is apparent from FIG. 1A, the respective pixels are aligned in the row direction, whereas the respective pixel rows are alternately shifted in the row direction, and hence the pixels are arranged in a staggered form as a whole in the column direction.

In order to realize a uniform electrode width throughout a large area, the row electrodes are formed by patterning an Al deposition film upon etching by a known technique of photolithography. The sustain discharge gap $L_{12}$ and the row electrode width $L_{13}$ are respectively set to be 0.25 mm and 0.15 mm.

Figure 7A:
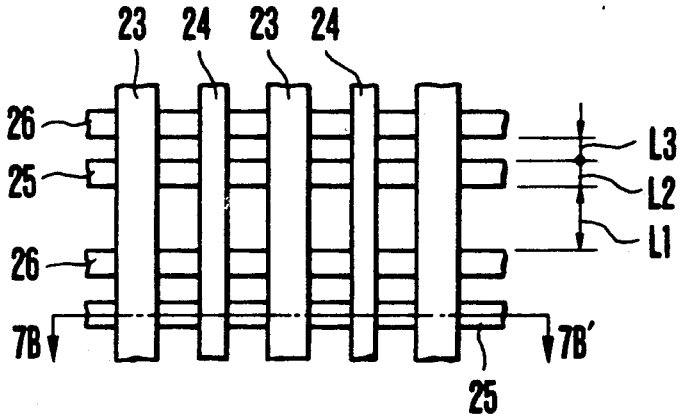
FIG.7A PRIOR ART
Figure 7B:
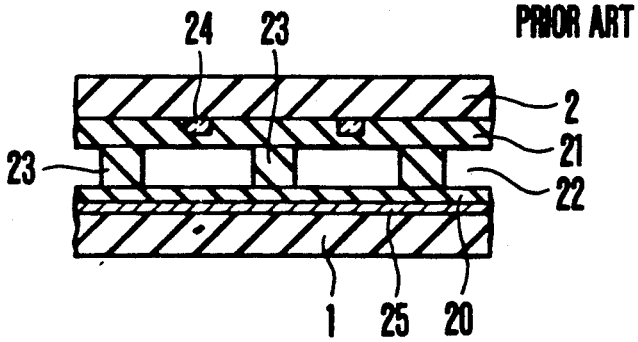
FIG.7B PRIOR ART
Figure 8A:
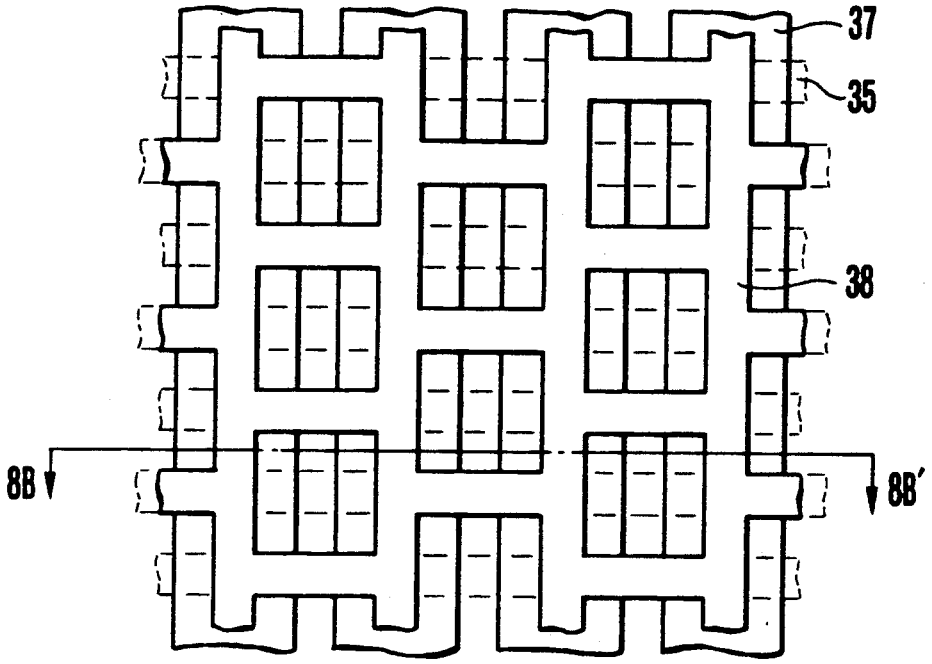
FIG.8A PRIOR ART
Figure 8B:
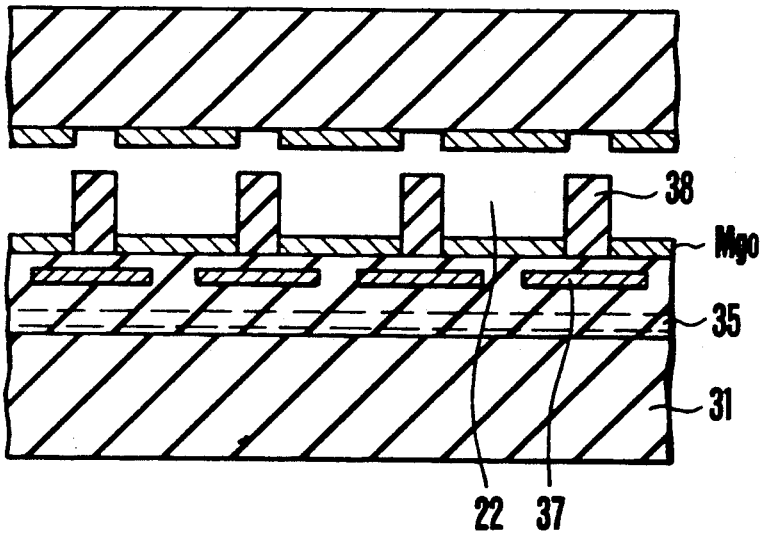
FIG.8B PRIOR ART

In the conventional plasma display shown in FIG. 7 which is cited in the description of "Background of the Invention", 0.19 mm is required for the row electrode spacing $L_1$. In the present invention, since such a spacing can be omitted, the resolution can be greatly increased while the pixel size remains the same as that of the conventional plasma display.

Figure 2A:
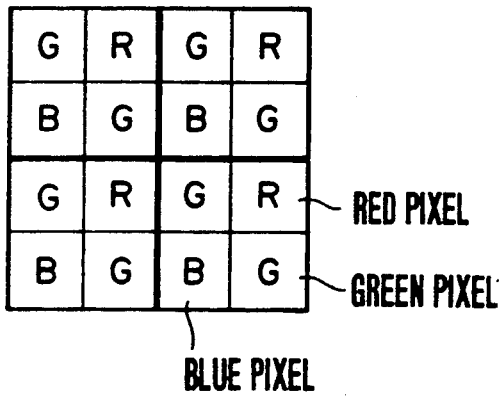
FIGS. 2A and 2B are views respectively showing color pixel arrangements of the plasma display having the structure shown in FIGS. 1A to 1C.
Figure 2B:
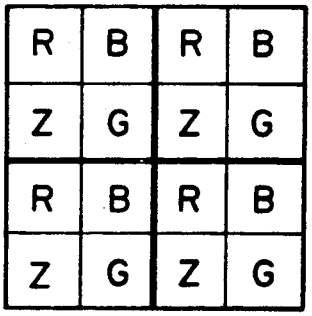

FIGS. 2A and 2B show phosphor arrangements employed when the present invention is applied to a color display. In FIG. 2A, a color trio is composed of two pixels of a green phosphor (G) having a high luminance, one pixel of a red phosphor (R), and one pixel of a blue phosphor (B). In FIG. 2B, an auxiliary discharge cell (Z) for causing an auxiliary discharge to stabilize the emission start voltage of each pixel is arranged for every three pixels.

Since one row electrode is commonly used for pixels of adjacent rows, transfer of a discharge to adjacent pixels must be prevented. For this purpose, the ribs 9 are not only arranged parallel to the column direction of the pixels 14 but also arranged on the respective row electrodes 7. This prevents transfer of a discharge in the column direction.

Figure 3:
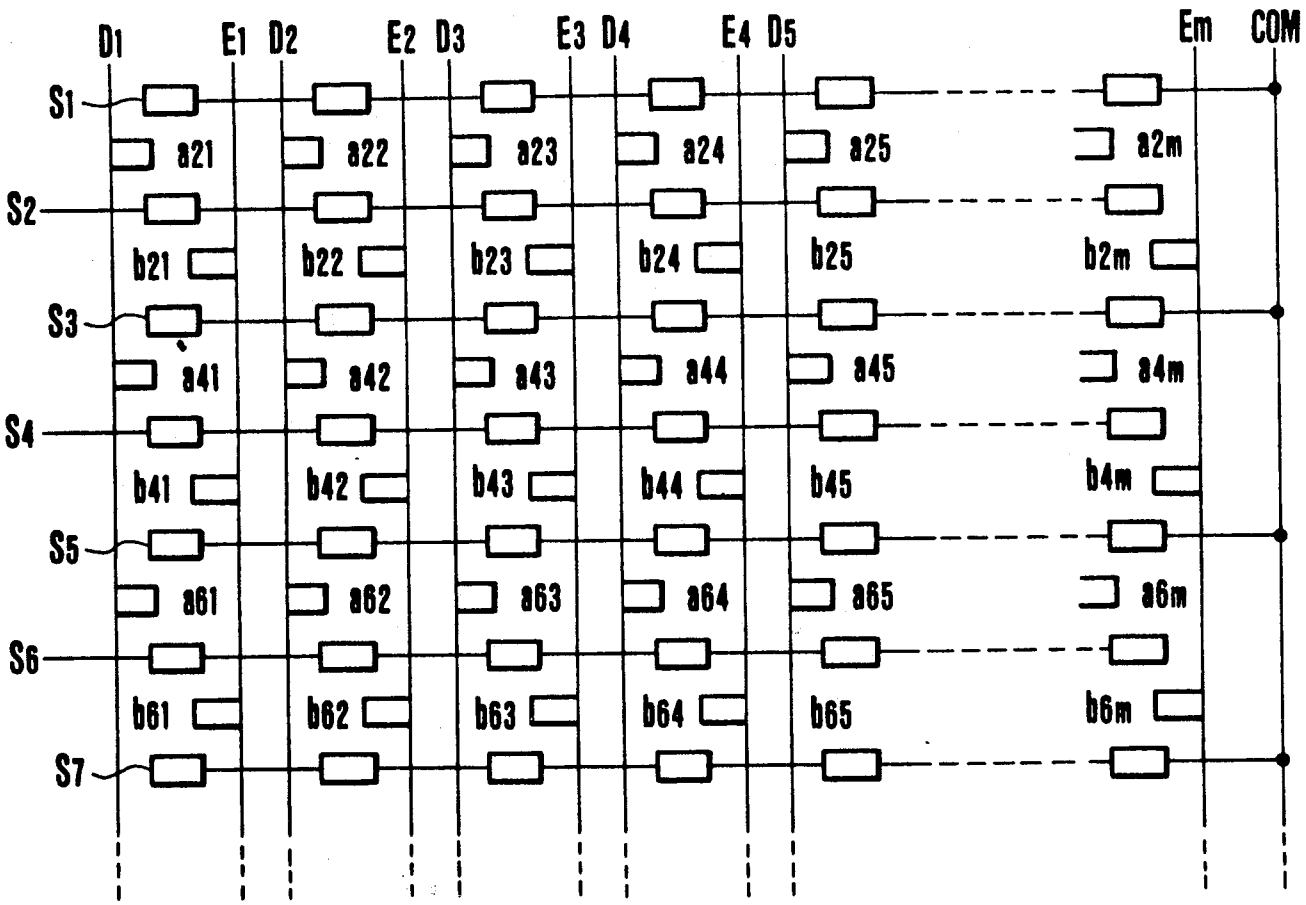
FIG. 3 is a view showing an arrangement of electrodes in the first embodiment of the present invention.
Figure 4:
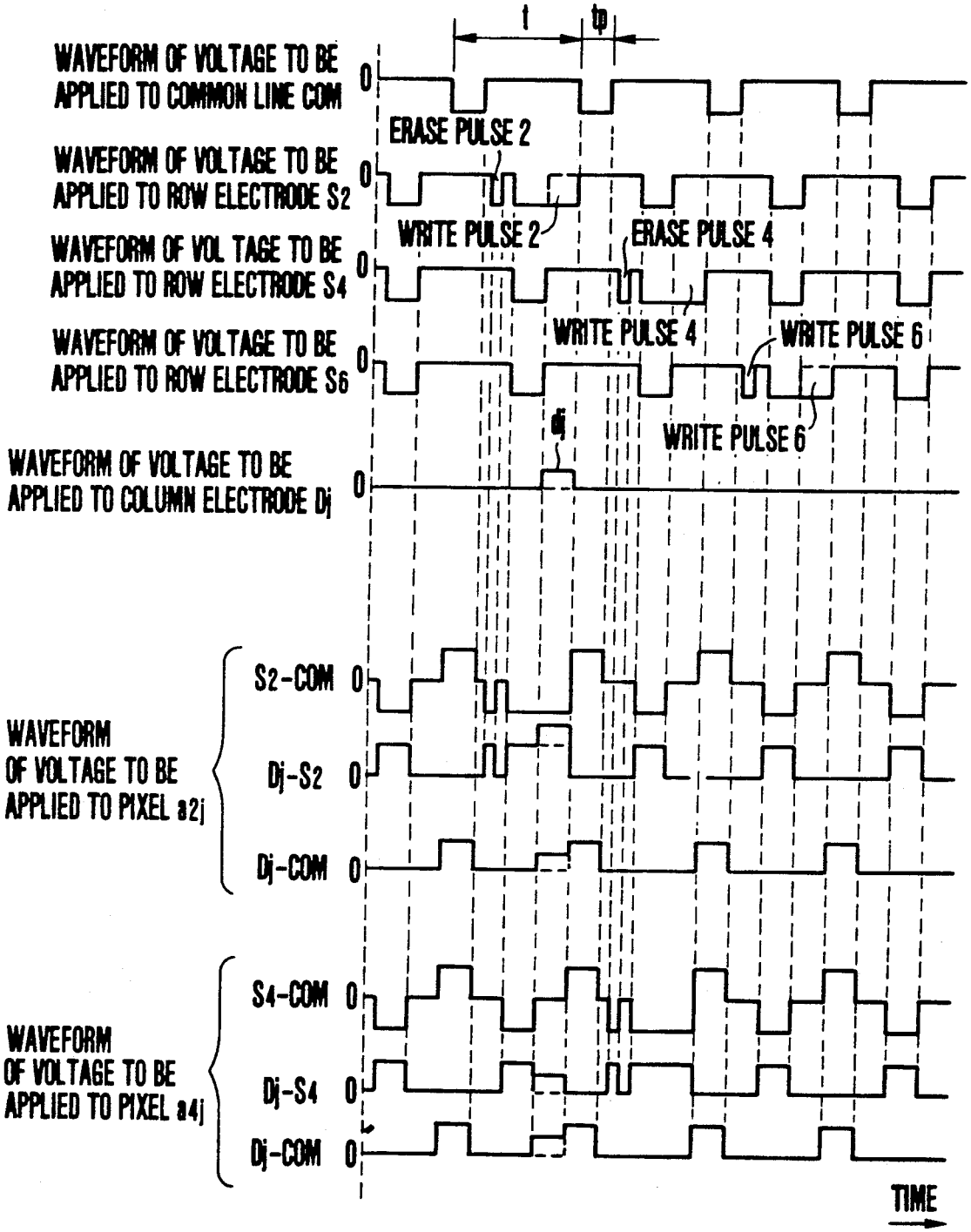
FIG. 4 is a timing chart showing the waveforms voltages to be applied to the respective electrodes in the first embodiment of the present invention.

FIG. 3 shows an electrode arrangement, a pixel arrangement, and electrode wiring of the plasma display of the present invention. Reference symbols $S_1$, $S_2$, $S_3$, . . . denote row electrodes. The odd row electrodes of these row electrodes are connected to a common line COM, and the even row electrodes are independently extracted. Voltages having independent waveforms are respectively applied to the even row electrodes. Reference symbols $D_1$, $D_2$, $D_3$, . . . denote odd column electrodes; and $E_1$, $E_2$, $E_3$, ..., even column electrodes. The odd column electrodes $D_1$, $D_2$, $D_3$, . . . are respectively connected to odd-row pixels $a_{21}$, $a_{22}$, $a_{23}$ . . ., $a_{41}$, $a_{42}$, $a_{43}$ . . , $a_{61}$, $a_{62}$, $6_{63}$, . . .. The even column electrodes $E_1$, $E_2$, $E_3$, . . . are respectively connected to even-row pixels $b_{21}$, $b_{22}$, $b_{23}$, . . ., $b_{41}$, $b_{42}$, $b_{43}$, . . ., $b_{61}$, $b_{62}$, $b_{63}'$ . . .. Therefore, the column electrodes are arranged in one-to-one correspondence with all the pixels located on both the sides of one row electrode. With this arrangement, when a write pulse is selectively applied to a given even row electrode, and a voltage pulse is applied to the column electrodes in synchronism with the write pulse, the pixels on both the sides of the given even row electrode can be simultaneously and independently controlled. FIG. 4 shows the waveforms of driving voltages to be applied to such a plasma display.

A sustain pulse having a signal period t is applied to the common line COM. The value of t depends on the number of scanning lines or data lines and is set be about 2 to 100 μs. In this embodiment, it is set to be 20 μs. In addition, a pulse width $t_p$ is set to be 5 μs in this embodiment. As shown in FIG. 4, in addition to a sustain pulse 180° out of phase from a pulse to be applied to the common line COM, an erase pulse $P_2$ and a write pulse $W_2$ are applied to the row electrodes $S_2$, $S_4$, $S_6$, . . .. The erase pulse $P_2$ and the write pulse $W_2$ are properly set within the range of 0.5 to 5 μs.

A voltage to be applied to, e.g., pixel $a_{2j}$ will be considered. A small-width pulse, as the erase pulse $P_2$, is applied first between the row electrode $S_2$ and the common line COM so as to neutralize the charge. If, therefore, the pixel $a_{2j}$ has been turned on before the application of the erase pulse $P_2$, the pixel $a_{2j}$ is turned off by the erase pulse $P_2$. The write pulse $W_2$ is then applied after application of a sustain pulse. If a data pulse $d_j$ is applied to a column electrode $D_j$ at this time in synchronism with the write pulse $W_2$ as shown in FIG. 4, the voltage between the column electrode $D_j$ and the row electrode $S_2$ is increased, and a firing source is generated. Subsequently, the discharge is sustained by row electrode $S_2$. If no data pulse $d_j$ is applied, since a voltage to be applied between the column electrode $D_j$ and the row electrode $D_2$ does not exceed a sustain pulse voltage, no discharge is started, and the pixel $a_{2j}$ is kept turned off.

By performing line-sequential selective scanning of the row electrodes $S_2$, $S_4$, $S_6$, . . ., ON/OFF control of each pixel can be performed. In the arrangement shown in FIG. 3, all the odd row electrodes are connected to the common line COM, and are commonly connected to a driving element. If, however, the driving element has a small current supply capacity or high-speed driving is required, the odd row electrodes may be divided into several groups and respectively connected to driving elements so as to be driven in units of groups.

In addition, the above-described voltage waveforms can be easily realized by using a currently available IC having a high breakdown voltage.

Figure 5A:
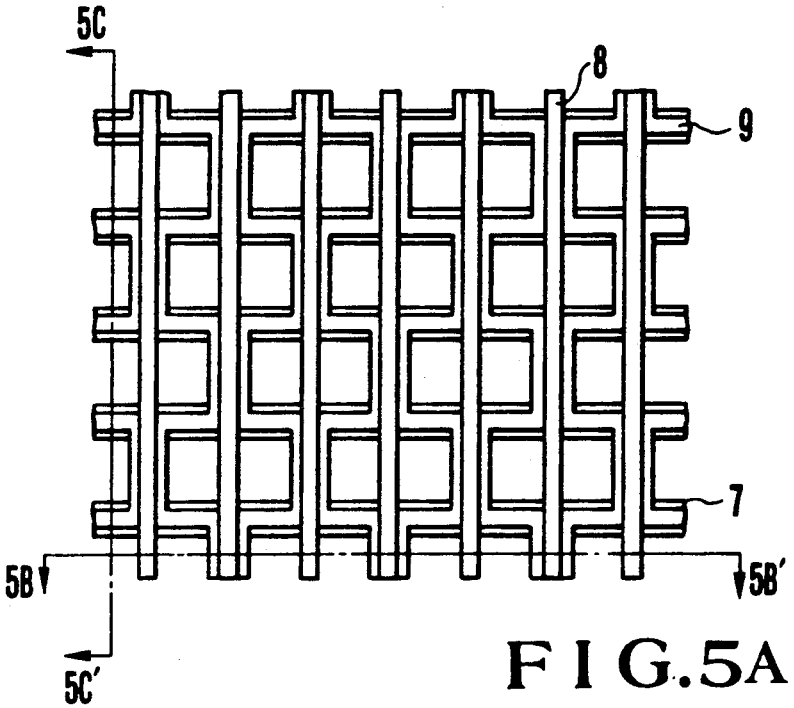
Figure 5B:
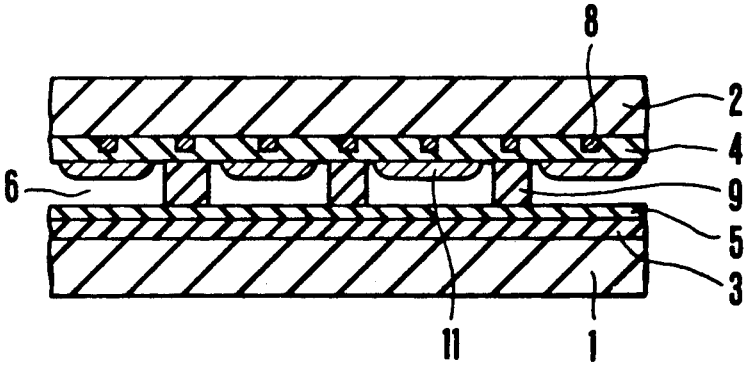
Figure 5C:
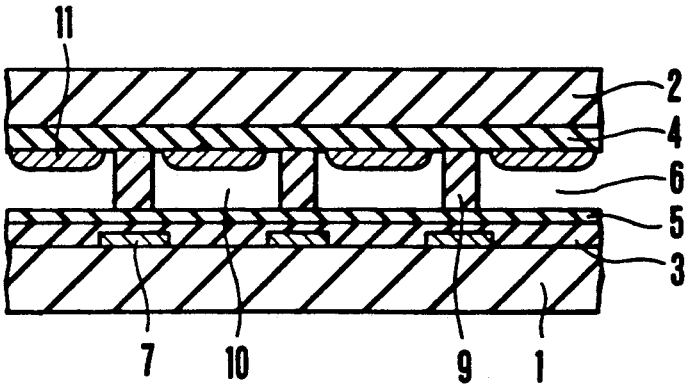

The second embodiment of the present invention will be described below. FIGS. 5A to 5C show a plasma display according to the second embodiment of the present invention.

Figure 6:
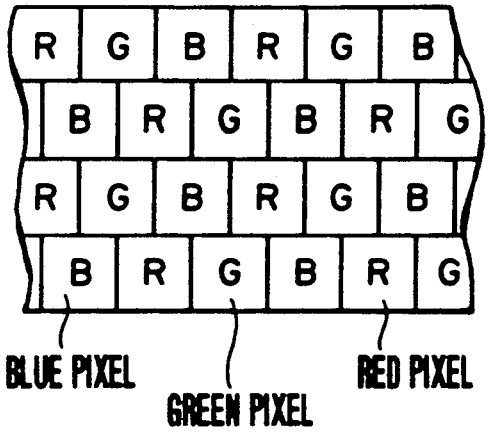
FIG. 6 is a view showing a color pixel arrangement of the plasma display having the structure shown in FIG. 3.

The same reference numerals in FIGS. 5A to 5C denote the same parts as in Figs. 1A to 1C, and a description thereof will be omitted. The second embodiment shown in FIGS. 5A to 5C is different from the first adjacent pixels are shifted from each other by ½ pixel. With this arrangement, since column electrodes 8 can be evenly distributed, the spacing between the adjacent column electrodes 8 can be increased, and a short-circuit between the electrodes can be easily prevented. Furthermore, in a color display, such an arrangement is advantageous in that a so-called triangular pixel arrangement can be realized. A triangular pixel arrangement is an arrangement in which pixels of three colors are arranged in the form of a triangle, as shown in FIG. 6. This arrangement is visually superior to other arrangements, and hence is also employed in a color CRT and the like. Similar to the first embodiment, in this arrangement, the pixel pitch can be reduced with the pixel size remaining the same in comparison with the conventional techniques. In addition, it is apparent that the capacitance between the row and column electrodes is smaller than that in the conventional techniques. Note that a driving method in the second embodiment is the same as that in the first embodiment.

In the first and second embodiments, small holes or gaps are respectively formed in the ribs between the pixels in order to evacuate the discharge gas spaces 6 or to feed a discharge gas therein, even though they are not shown for the sake of simple illustration.

As a material for the column electrodes 8, a metal material may be used as well as a Nesa film or ITO as a material for transparent electrodes.

The numerical values mentioned in the respective embodiments are only examples, and do not limit the application range of the present invention.

As has been described above, in comparison with the conventional techniques, in the present invention, the row electrode spacing between adjacent rows can be omitted, and the number of row electrodes can be reduced to half. Therefore, a color plasma display having a higher resolution than the conventional displays can be realized by employing the same row electrode width and sustain discharge gap as those in the conventional displays. In addition, since the row electrode pitch can be reduced as compared with the conventional techniques even with a row electrode width larger than that in the conventional techniques, disconnection of row electrodes can be effectively prevented by using wide row electrodes, thus realizing a highly reliable color plasma display. Moreover, since row and column electrodes are arranged on different substrates, the capacitance between each row electrode and a corresponding column electrode can be reduced, and the power consumption associated with charge/discharge operation of a capacitance can be reduced. This allows high-speed driving, and hence a large color plasma display can be easily driven.

What is claimed is:

1. A plasma display comprising:

discharge gas spaces constituting a plurality of pixels;

first and second insulating substrates which are arranged parallel to each other so as to sandwich between them said discharge gas spaces;

firs stripe odd row electrodes and second stripe even row electrodes arranged on a surface of said first insulating substrate which opposes said discharge gas spaces;

means for applying sustaining pulse voltages to said first stripe odd row electrodes, means for applying sustaining pulse voltages, scanning pulse voltages, and erase pulse voltages to said second strip even row electrode;

an insulating layer stacked on said first and second stripe row electrodes;

a protective layer stacked on said insulating layer;

stripe column electrodes which are arranged on a surface of said second insulating substrate, which opposes said discharge gas spaces, in a direction perpendicular to said row electrodes;

an insulating layer stacked on said column electrodes;

phosphors stacked on said insulating layer at positions corresponding to said pixels, respectively; and ribs, arranged on said row electrodes, for defining said pixels, thereupon commonly using one row electrode for pixels adjacent rows in a direction perpendicular to said row electrode.

2. A display according to claim 1, wherein said pixels are aligned in a row direction, and rows of said pixels are alternately shifted in a row direction so that said pixels are arranged in a staggered form as a whole in the column direction, and pixels of three colors are arranged in a form of a triangle in order to give a full color display.

* * * * *